US005871053A

United States Patent [19]

Stern

[11] Patent Number: 5,871,053

[45] Date of Patent: Feb. 16, 1999

[54] METHOD FOR IMPROVING OIL RECOVERY FROM A FORMATION USING HYDROCARBON ANALYSIS OF THE FLUID PRODUCED THEREFROM

[75] Inventor: David Stern, Houston, Tex.

[73] Assignee: Exxon Production Research Company, Houston, Tex.

[21] Appl. No.: 822,172

[22] Filed: Mar. 21, 1997

[51] Int. Cl.[6] ..... E21B 43/00

[52] U.S. Cl. ..... 166/401; 166/402

[58] Field of Search ..... 166/401, 402, 166/264

[56] References Cited

U.S. PATENT DOCUMENTS 5,285,848 2/1994 Chang ..... 166/402 X 5,711,373 1/1998 Lange ..... 166/402 X

OTHER PUBLICATIONS

McGuire, P. L. and Stalkup, F. I., "Performance Analysis and Optimization of the Prudhoe Bay Miscible Gas Project", SPE 22398, SPE International Meeting On Petroleum Engineering, Beijing, China, Mar. 24–27, 1992, pp. 719–728.

McGuire, P.L. and Moritz Jr., A. L., "Compositional Simulation and Performance Analysis of the Prudhoe Bay Miscible Gas Project", SPE 20759, 65th Annual Technical Conference And Exhibition Of The Society Of Petroleum Engineers, New Orleans, LA, Sep. 23–26, 1990, pp. 439–448.

Mizenko, G. J., "North Cross (Devonian) Unit CO2 Flood: Status Report", SPE/DOE 24210, SPE/DOE Symposium On Enhanced Oil Recovery, Tulsa, OK, Apr. 22–24, 1992, pp. 537–546.

Hervey, J. R. and Iakovakis, A.C., "Performance Review of a Miscible CO2 Tertiary Project: Rangley Weber Sand Unit, Colorado", SPE 19653, 64th Annual Technical Conference And Exhibition Of The Society Of Petroleum Engineers, San Antonio, TX, Oct. 8–11, 1989, pp. 253–265.

Stern, D., "Mechanisms of Miscible Oil Recovery: Effects of Pore–Level Fluid Distribution", SPE 22652, 66th Annual SPE Technical Conference, Dallas, TX, Oct. 6–9, 1991, pp. 579–594.

Shyeh–Yung, J. J. and Stadler, M. P., "Effect of Injectant Composition and Pressure on Displacement of Oil by Enriched Hydrocarbon Gases", SPE Reservoir Engineering, May, 1995, pp. 109–115.

Huang, W. W., Bellamy, R. B. and Onimus, S. W., "A Study of Nitrogen Injection for Increased Recovery From a Rich Retrograde Gas/Volatile Oil Reservoir", 1986 International Meeting On Petroleum Engineering, SPE 14059, Beijing, China, Mar. 17–20, 1986, pp. 157–172.

Fox, M. J., Simlote, V. N., and Beaty, W. G., "Evaluation of CO2 Flood Performance, Springer A Sand, NE Purdy Unit, Garvin County, OK", SPE/DOE 12665, SPE/DOE 4th Symposium On Enhanced Oil Recovery, Tulsa, OK, Apr. 15–18, 1984, pp. 347–351.

*Primary Examiner*—William Neuder

*Attorney, Agent, or Firm*—Kurt D. VanTassel

[57] ABSTRACT

The invention described here is a method for using produced fluid compositions to decide how to modify injection/production strategies in oil recovery processes that involve injection of non-aqueous recovery agents ("Injectant"). The procedure is based on the premise that once a given zone is swept by injectant, most subsequent hydrocarbon recovery from that zone will occur by vaporization or extraction into the injectant. Because only the most volatile hydrocarbon components can be extracted, hydrocarbons produced by displacement can be distinguished from those produced by extraction by examining the hydrocarbon composition. Heavy, non-volatile components are recovered only by displacement. The disclosed method determines quantities of displaced vs. extracted hydrocarbons by comparing the produced hydrocarbon composition to that of the original in-place oil. Such information may be used to modify operations in order to most effectively use injectant to recover hydrocarbons from the reservoir.

6 Claims, 3 Drawing Sheets

METHOD FOR IMPROVING OIL RECOVERY FROM A FORMATION USING HYDROCARBON ANALYSIS OF THE FLUID PRODUCED THEREFROM

FIELD OF THE INVENTION

The present invention relates to a process for recovering a hydrocarbon liquid from a subterranean formation by introducing a substantially non-aqueous displacement fluid or by introducing a substantially non-aqueous displacement fluid in alternating sequence with water. More specifically, the invention relates to an improved method of modifying the displacement process based on its current performance.

BACKGROUND OF THE INVENTION

An oil reservoir consists of a subterranean formation with small interconnected pores filled with hydrocarbon liquid, gas, and water, usually at an elevated pressure. The hydrocarbon liquid phase at reservoir temperature and pressure, hereafter termed "oil", includes liquid crude oils and liquid crude oils containing dissolved gases (e.g., methane ($CH_4$), ethane ($C_2H_6$), propane ($C_3H_8$), butanes ($C_4H_{10}$), carbon dioxide ($CO_2$), nitrogen ($N_2$), and hydrogen sulfide ($H_2S$)). The volume fraction of each phase in the porespace is referred to as its "saturation". The formation in which the oil, water, and gas reside consists of strata of varying ability to conduct fluid. The ability of the formation to conduct fluid is measured by its permeability, defined as the ratio of flow rate to the product of applied pressure gradient and fluid viscosity. In high permeability strata, large flow rates can be sustained with relatively low pressure gradients.

Initially, oil is produced from the formation by "primary" production methods that utilize the energy present in the fluids in the formation. For example, primary production can occur by fluid expansion upon a decrease in reservoir pressure.

A high oil saturation usually remains after primary production. At this point, "secondary" recovery techniques are often implemented to recover additional oil. The most common secondary recovery process is a "waterflood" in which large quantities of water are injected into the formation through specified wells to displace oil towards production wells in the vicinity.

In many cases, a high oil saturation is present after the waterflood. This results in part from the high interfacial tension between oil and water. Interfacial tension traps oil in the porespace. "Tertiary" processes are sometimes initiated at this point. The most common commercially applied tertiary recovery process involves injection of substantially non-aqueous fluids to displace oil towards production wells. These non-aqueous fluids are typically high pressure gases or supercritical fluids, which will be referred to as tertiary recovery fluids.

A supercritical state for a fluid exists when the temperature and pressure exceed the fluid's critical density, temperature, and pressure. Below a fluid's critical temperature ($T_c$) and critical pressure ($P_c$) the fluid can consist of both a gas and liquid coexisting in a gas-liquid equilibrium. Above and around $T_c$, and $P_c$, however, the fluid can exist only in a single phase, known as a supercritical fluid. For example, water has a $T_c$=374° C. and a $P_c$=$2.21\times10^7$ pascals. Consequently, if water is at a pressure close to its critical pressure, it will become increasingly turbid and milky as the temperature is lowered from a temperature well above to its critical temperature, 374° C., down to its critical temperature. Upon slight additional cooling below the critical temperature the turbidity disappears and two distinct liquid and vapor phases form. A supercritical fluid's properties, such as density, are intermediate between a gaseous and liquid state for the same substance, but are typically more like the corresponding liquid state. Consequently, a supercritical fluid will normally behave more like a liquid than a gas in terms of its physical behavior thereby enhancing its ability to displace and/or extract hydrocarbons from a formation during tertiary recovery.

Fluids commonly used for tertiary recovery are carbon dioxide, nitrogen, methane, and ethane. Such a process is typically referred to as a "gas injection process." When a tertiary injection fluid, also called the injectant, is used in a gas injection process, hydrocarbon components in the oil vaporize into the injectant, modifying the properties of both the oil and injectant so the interfacial tension between them is reduced. The result is that a substantially non-aqueous injectant can reduce the oil saturation below that seen at the end of the waterflood. The physics of this process are described in petroleum engineering texts well known to those skilled in the art.

FIG. 1 illustrates some of the important recovery mechanisms in a gas injection process. It shows a formation with two zones, 102 and 104, with different values of permeability. The higher permeability zone, 104, is completely swept before the lower permeability zone, 102, is completely swept. Once a zone is completely swept with injectant it is typically referred to as a "swept zone," while a zone where the injectant sweep is incomplete is referred to as an "unswept zone." Note that if a zone is said to be "completely swept", it does not mean that all possible oil has been recovered from that zone; rather, it means that the injectant has passed through the entire zone.

Even in zones that are swept, pockets of bypassed oil are present. After a swept zone has been established, continued injection of the injectant, 101, results in extraction of hydrocarbons from residual pockets of oil, 108, remaining after the initial injectant sweep through the higher permeability zone, 104. The result is that a mixture of injectant and extracted hydrocarbons, 105, is produced from the swept zone, 104. Accordingly, in addition to recovering oil by direct displacement, the injectant extracts, by a vaporization process, some of the more volatile hydrocarbon components in the residual oil that remain in the swept zone. This vaporization process is referred to as "extraction". Extraction results in production of hydrocarbons that are initially comprised of more volatile components and progressively become comprised of less volatile components as injectant is recycled and reinjected through the swept zone.

As shown in FIG. 1, a water and hydrocarbon mixture, 103, is produced as injectant, 101, displaces the water and hydrocarbons originally in place, therefore leaving residual pockets of oil, 106, in the lower permeability zone, 102.

Therefore, injectant is used to (1) recover hydrocarbons by displacing hydrocarbons originally in place in the formation and (2) extract hydrocarbon components from bypassed oil remaining after the injectant completes its first sweep in a particular zone. The result is that during gas injection processes, the produced hydrocarbon fluid will be a mixture of displaced and extracted hydrocarbons.

Examples of such displacement/extraction processes on a laboratory scale are given by Stern (1991), and Shyeh-Yung and Stadler (1994), and in field tests by Fox, Simlote, and Beaty (1984). Mathematical models of the oil recovery process also predict this behavior. For example, Huang, Bellamy, and Ohnimus (1986) have described the results of such mathematical modeling.

In practice, the amount of oil recovered from gas injection processes depends on the injectant's effectiveness in (1) displacing the oil's hydrocarbon components, (2) extracting the oil's hydrocarbon components and (3) uniformly contacting the formation. For example, injectant may flow predominantly through high permeability strata and bypass lower permeability portions of the formation altogether. Computer simulation (mathematical modeling) is used to predict how much oil will be recovered, given a description of the formation and an estimate of the remaining oil saturation after gas flooding.

Despite using all available information to design a gas injection process, there are often large uncertainties about the spatial arrangement of the formation's permeability and porosity. This can have a large impact on the performance of the gas injection process. As a result, it is almost always necessary to modify the injection process based on the formation's actual response to injection of the injectant. In operating gas injection projects, gas, water, and oil production rates at individual production wells are used to determine near-term gas injection strategies. Typically, the injectant is redirected away from wells that are producing at an elevated gas-oil ratio (GOR) and towards low GOR wells. Injectant-oil-ratio is also used for this purpose, when appropriate data are available. This is preferred, since injectant-oil-ratio better indicates how much injectant is produced at a given well. McGuire and Stalkup (1992) have described use of this technique at Prudhoe Bay, a field in Alaska currently under hydrocarbon gas flooding. In this case, complex analyses are required to distinguish produced injectant from produced in-place gas. The problem with either of these approaches is that the engineer cannot precisely determine from the available data what fraction of the produced hydrocarbons result from (1) direct displacement of hydrocarbons by the injectant in the lower permeability zone versus (2) extraction of hydrocarbons by the injectant passing through the swept zone. For example, in certain instances, the injectant may extract economically significant quantities of volatile hydrocarbons, including but not limited to methane ($C_1$), ethane ($C_2$), propane ($C_3$), butane ($C_4$), pentane ($C_5$), hexane ($C_6$), heptane ($C_7$), and/or octane ($C_8$), from higher permeability zones in the formation completely swept by injectant. Consequently, the continued injection of the tertiary recovery fluid is economically justified. However, as more of the residual volatile components are extracted from the swept zone, the injectant will inefficiently cycle through the zone. As the zone becomes significantly depleted of its residual hydrocarbons it becomes identified as a "thief zone," because the zone (1) takes injectant that could otherwise be used for directly displacing and/or extracting hydrocarbons, and (2) produces relatively small amounts of hydrocarbons.

Thus, there is a need for a method for determining the relative percentage of hydrocarbons produced by (1) injectant extraction from gas-swept zones and (2) injectant displacement of hydrocarbons from unswept zones of a subterranean formation. Such a method would be valuable in helping to manage and maximize the economically efficient use of injectant in field-scale gas injection processes.

SUMMARY OF INVENTION

According to the invention, there is provided a method for producing a fluid having hydrocarbons from a subterranean formation resulting from introducing a substantially non-aqueous injectant into the formation, comprising:

a) obtaining a first fluid sample from the formation before introducing said non-aqueous injectant into the formation;

b) determining the composition of non-injectant hydrocarbons in said first fluid sample;

c) obtaining at least a second fluid sample from the formation after introducing said non-aqueous injectant into the formation;

d) determining the composition of non-injectant hydrocarbons in said second fluid sample;

e) determining the fraction of produced hydrocarbon fluid that is recovered by displacement using said compositional results in steps b) and d); and f) using said fraction result in step e) to guide adjustment of at least one of the rates at which said fluid is produced from the formation and said non-aqueous injectant is introduced into the formation, so that the amount of non-aqueous injectant used per unit of hydrocarbons produced from the formation is minimized.

Preferred embodiments of the invention include:

(1) determining the fraction in step (e) by a) calculating the normalized mole fraction of each hydrocarbon component using the compositional results of steps of b) and d); and b) plotting each said normalized fraction versus each said hydrocarbon component; and (2) performing said calculation step by dividing the mole fraction of each non-injectant hydrocarbon component in said second fluid sample by the mole fraction of the corresponding component in said first fluid sample.

DETAILED DESCRIPTION OF THE INVENTION

1. Hydrocarbon Concentrations Produced by Displacement v. Extraction Processes

Figure 1:
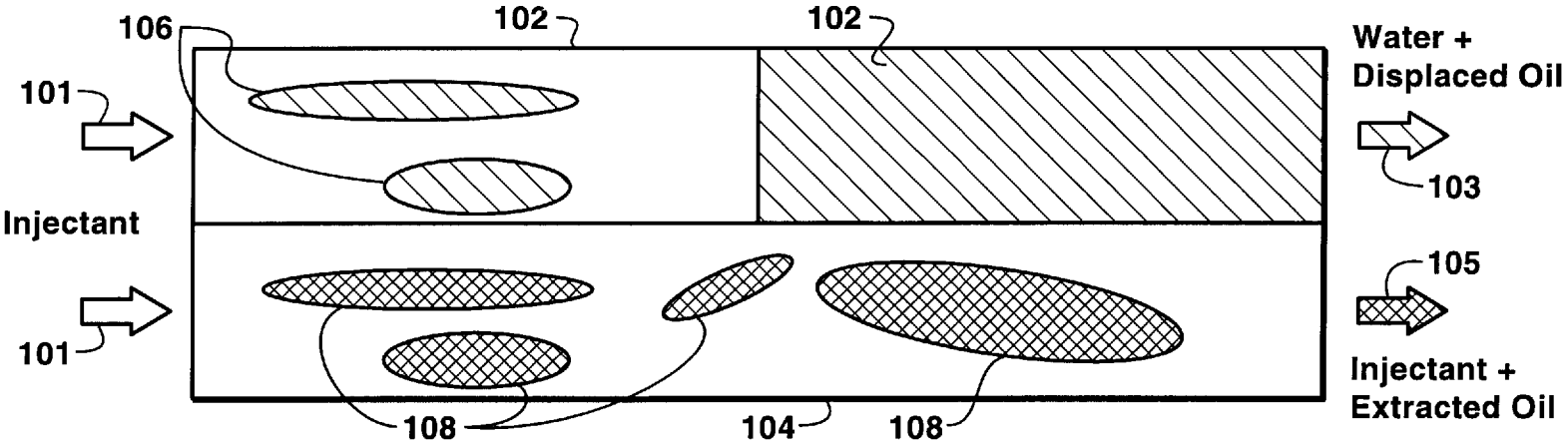
FIG. 1 Prior Art
FIG. 1 illustrates two subterranean formation zones including a higher permeability swept zone and a lower permeability unswept zone.
Figure 2:
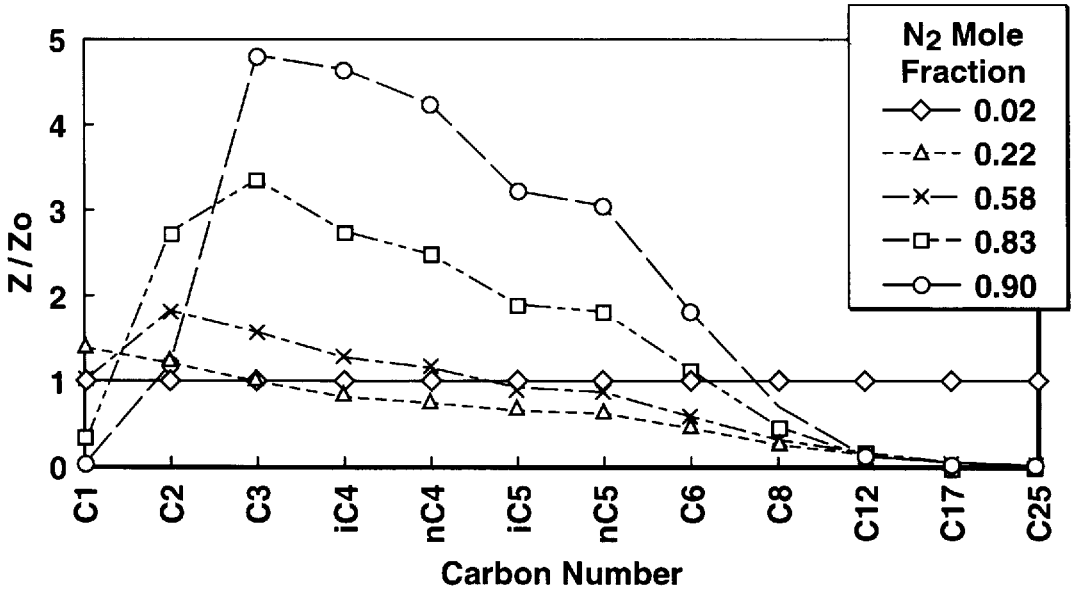
FIG. 2 illustrates a plot of normalized mole fraction of hydrocarbon component as a function of carbon number, derived from a 1-dimensional computer simulation, based on using nitrogen as an injectant.

To understand how produced fluid composition depends on whether the fluid is displaced or extracted, it is useful to examine results of computer simulations. FIG. 2 illustrates the results of one-dimensional computer simulation predictions for the extraction process arising-at five different times during a displacement where high pressure nitrogen is injected to displace crude oil from a homogeneous reservoir. The crude oil properties were set to correspond to oil and hydrocarbon gas produced from the Jay field in northwest Florida, which is currently under nitrogen injection.

In a one-dimensional simulation the injection and production wells are at opposite ends of the reservoir, boundary conditions are set so that the flow is uniform, and gravity effects are neglected. As a result, the fluid saturations during a one-dimensional simulation vary only in the direction of flow. Consequently, the hydrocarbon fluid saturation depends only on the distance from the injection well and the volume of fluid that has been injected. This simulation represents behavior that is typical for a zone swept by nitrogen.

FIG. 2 is a plot of computer simulation predictions of normalized mole fractions of various hydrocarbon components, $C_1$–$C_{25}$, in the produced oil. Each hydrocarbon component mole fraction, $Z_j$, is normalized to its respective mole fraction, $Z_0$, in the original oil. Thus, the normalized mole fraction of component j, $Z_{jn}$, is obtained by taking the ratio of the mole fraction concentration for component j in the produced non-injectant hydrocarbon to the mole fraction concentration for component j as it existed in the initial pre-production (non-injectant) hydrocarbon. The normalized mole fraction for each hydrocarbon component is plotted as a function of carbon number for five values of injectant (i.e., nitrogen) mole fraction found in the produced fluid. Displaced oil has the same composition as the original oil, since all components are displaced at the same rate. Consequently, during the displacement phase of hydrocarbon production the normalized mole fraction for each component remains at 1.0.

Before injectant reaches the producer, the injectant concentration is zero, and the normalized mole fraction is 1.0 for all components. After injectant breaks through, the injectant mole fraction increases. In this case, nitrogen is the injectant; increasing nitrogen mole fraction in FIG. 2 corresponds to further injection of nitrogen. After injectant reaches the producer, the injectant preferentially extracts the volatile hydrocarbons from pockets of residual hydrocarbons in the swept zone. Such residual hydrocarbons are also known as bypassed hydrocarbons. The hydrocarbon components that are not extractable with an injectant will remain in the swept zone indefinitely.

The changes in produced hydrocarbon composition shown in FIG. 2 are explained as follows: Once the injectant, nitrogen in this instance, is produced, nitrogen breakthrough has occurred and continued production of hydrocarbons results from extraction of volatile components from bypassed oil. Earlier in the extraction phase, more volatile components are preferentially extracted from bypassed hydrocarbons, so the normalized $C_1$ concentration initially increases from unity, and subsequently declines to zero when all $C_1$ has been extracted. As the normalized $C_1$ concentration decreases, extraction of $C_2$ begins, and a corresponding increase is seen in the normalized concentration of $C_2$. Eventually, the swept zone is depleted of ethane, and the ethane concentration declines. This is accompanied by an increase in the concentration of propane, $C_3$. This process continues, and eventually, at high values of the nitrogen mole fraction, increases are seen in the normalized concentration of components containing five or more carbon atoms. Thus, hydrocarbon components are extracted in order of volatility.

Once most extractable hydrocarbons have been produced from the swept zone, all hydrocarbon components, whether extractable or unextractable type components, are produced exclusively by the displacement process from the unswept zone. This is a critical point in the hydrocarbon recovery process where a substantial portion of the injectant, if freely injected thereafter, will be wasted as it passes through the swept zone without extracting any new hydrocarbons. Therefore, once most extractable hydrocarbons have been produced from the swept zone, it would be desirable to modify the injectant's injection rate to ensure the injectant is used efficiently.

2. Equations Related to Determining Quantities of Hydrocarbon Produced by Direct Displacement As discussed above, some zones in a formation have higher permeabilities than others. These higher permeability zones are swept by injectant earlier in the gas injection process. Consequently, after injectant breakthrough occurs, the hydrocarbon fluids produced comprise a mixture of both displaced hydrocarbons, from the lower permeability zones, and extracted hydrocarbon fluids and injectant (e.g., nitrogen ($N_2$)), from the swept zone(s). The invention described herein comprises four key steps for determining the portion of hydrocarbon fluids produced by direct displacement versus extraction. The calculation used for practicing the invention is based on the premise that the portion of the hydrocarbon fluids produced by direct displacement can be found by determining the portion of unextractable hydrocarbon components (i.e., components not volatile enough to be extracted by the injectant present in the production stream). This is done by examining plots of the normalized mole fraction as a function of carbon number.

To better understand how plots of normalized mole fraction vs. carbon number can be used to make this determination, it is useful to examine several equations related to the composition of a mixture of hydrocarbons recovered from both the swept and unswept zones. For each mole of produced fluid, $f_e$ is the fraction of fluid produced from the swept zone, and therefore, represents only extractable hydrocarbons and the injectant (e.g., $N_2$). The remaining fluid, $1-f_e$, is the fraction of each mole of produced fluid that is produced by displacement, and therefore, represents both lower carbon number hydrocarbons (i.e., extractable type hydrocarbons) and higher carbon number hydrocarbons (i.e., unextractable type hydrocarbons) produced from the unswept zone. Accordingly, in the case where extractable type hydrocarbons are produced concurrently from the swept zone by extraction and from the unswept zone by displacement and unextractable type hydrocarbons are produced from the unswept zone by displacement, the normalized mole fraction of a given component, j, is given by:

$$Z_{jn} = \frac{Z_{je}f_e + (1 - f_e)Z_{jo}}{Z_{jo}(1 - f_e Z_{N2})} \quad (1)$$

where, $Z_{jn}$=the normalized mole fraction of component j, $Z_{je}$=the mole fraction of hydrocarbon component j in the fluid produced from the swept zone, $Z_{jo}$=the mole fraction of component j in the original oil, $Z_{N2}$=the mole fraction of $N_2$ in the fluid produced from the swept zone.

Equation 1 is based on one mole of produced fluid. In the numerator of Equation 1, the first term, $Z_{je}f_e$, represents the amount of hydrocarbon component j produced from the swept zone, while the second term, $(1-f_e)Z_{jo}$, represents the amount of hydrocarbon component j present in the oil produced by displacement from the unswept zone. In the denominator, the quantity $(1-f_eZ_{N2})$ represents the amount of hydrocarbon produced from both the swept and unswept zones, and $Z_{jo}$, represents the normalizing mole fraction of component j in the original oil.

As discussed above, once injectant breaks through, unextractable hydrocarbon components cannot be produced from the swept zone with an injectant. Consequently, the mole fraction of each unextractable hydrocarbon component in the fluid from the swept zone, $Z_{je}$, is zero. For all unextractable components in the swept zone $Z_{je}=0$, and Equation 1 reduces to:

$$Z_{jn} = \frac{1 - f_e}{1 - f_e Z_{N2}} = D \tag{2}$$

The numerator in Equation 2 represents the amount of hydrocarbons present in the fluid produced from the unswept zone (by displacement), while the denominator in Equation 2 represents the total amount of hydrocarbons produced. Thus, the quantity D defined in Equation 2 represents the fraction of the total produced hydrocarbon that is recovered by displacement. Because $f_e$ and $Z_{N2}$ are constant for a given sample, D will remain constant for all unextractable components. Thus, Equation 2 indicates that the normalized mole fraction for each unextractable hydrocarbon component will equal the mole fraction of the produced hydrocarbon that is recovered by direct displacement. Consequently, the displaced fraction D can be determined by inspection from a plot of $Z_{jn}$ versus relative volatility, as expressed by carbon number. For the lower volatility carbon numbers (i.e., $C_7$ and greater) the normalized mole fraction for each component produced from the swept zone remains at a plateau value.

3. Determining the Quantity of Hydrocarbons Produced by Direct Displacement

To determine the quantity of hydrocarbons produced for a given well by direct displacement, preferably three steps are carried out: a) the composition of produced hydrocarbon (both gas and liquid), on an injectant-free basis, is determined from representative separator hydrocarbon samples; b) the normalized mole fraction of each hydrocarbon component in the produced hydrocarbon sample is calculated; and c) the normalized mole fraction for each hydrocarbon sample is plotted as a function of carbon number. This plot is used to determine what fraction of the produced hydrocarbon is recovered by displacement. As discussed above, the normalized mole fraction of an unextractable hydrocarbon component in the produced fluid-will be equal to the fraction of the produced hydrocarbon that is recovered by displacement. The normalized mole fraction of unextractable hydrocarbons will be indicated by the plateau value obtained for large carbon numbers.

Figure 3:
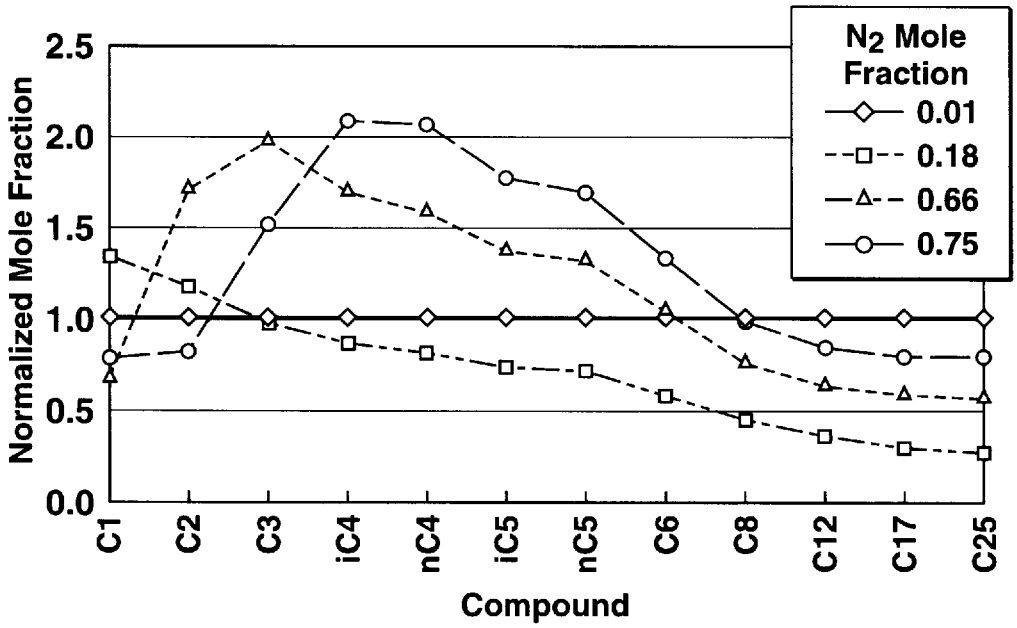
FIG. 3 illustrates a plot of the normalized mole fraction of mixtures of extracted and displaced hydrocarbons as a function of carbon number, assuming that 80% of the fluid comes from the swept zone; displaced hydrocarbons have the same composition as the original oil, while fluid from the swept zone, which is recovered by extraction, has the compositions shown in FIG. 2.

FIG. 3 illustrates the type of behavior expected in such a plot. The Figure illustrates the normalized mole fraction that would be obtained for four separate hydrocarbon samples where 80% of the produced fluid is obtained from the swept zone. The composition of the fluid produced from the swept zone fluid varies as the nitrogen mole fraction in the produced fluid increases over time. Based on compositional simulations of nitrogen displacing Jay crude oil, these curves are the normalized mole fractions of mixtures of original crude oil and displacement effluent shown in FIG. 2 at different times during the displacement. Increasing nitrogen mole fraction in the effluent corresponds to the passage of time during nitrogen injection.

Turning back to FIG. 3, shortly after nitrogen break through occurs, the nitrogen mole fraction is 0.01 and the normalized mole fraction for all hydrocarbon components is unity, indicating that the composition of the mixture is identical to that of the original oil in place. As the nitrogen mole fraction increases, the produced hydrocarbons are comprised substantially of lighter hydrocarbons. With time, the produced hydrocarbons comprise heavier hydrocarbons. Each curve has a plateau, however, for hydrocarbon components containing 12–25 carbon atoms, which cannot be extracted by nitrogen. These components are produced only in the oil that is recovered by displacement from zones where gas has not yet broken through. Therefore, reading the approximate plateau values from FIG. 3, the normalized mole fractions of C12–C25 components obtained by displacement are 0.25, 0.55, and 0.075 respectively, corresponding to 0.18, 0.66, and 0.75 mole fractions of $N_2$ injectant produced. The plateau value of the normalized mole fraction gives the quantity D, the fraction of produced (non-injectant) hydrocarbon that is recovered by displacement. This is expected based on Equation 2.

Each of the three steps outlined above is described in more detail below.

(a): Determine Composition

Separator hydrocarbon compositions are found using conventional gas chromatography (GC) and simulated distillation, respectively, coupled with gas-to-oil ratios ("GOR"). Hydrocarbon compositions are computed using a hydrocarbon analysis performed on an injectant-free basis, meaning that when a hydrocarbon, such as methane or ethane, is used as an injectant, the composition of the non-injectant components is used to calculate normalized mole fraction, to avoid confusion about whether a given component comes from the injectant or the in-place fluid.

Figure 4:
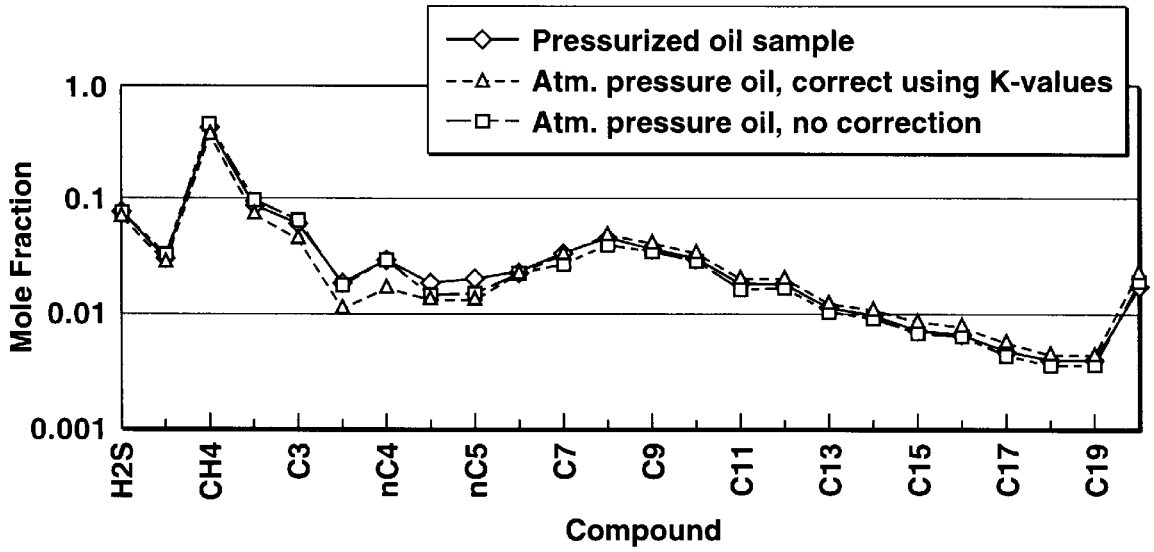
FIG. 4 illustrates hydrocarbon compositions for three different oil sample collection and analysis procedures including a pressurized sample, an atmospheric sample corrected using K-values, and an atmospheric sample with no correction.

Preferably, samples are taken at separator pressure. However, if K-values (i.e., the ratio of gas to liquid phase for a component in a mixture at thermodynamic equilibrium) of lighter components are known, hydrocarbon samples under atmospheric pressure can be used. FIG. 4 illustrates hydrocarbon compositions for three different sample collection and analysis procedures. In one case, both oil and gas samples were collected at separator pressure and temperature. This represents the most accurate measurement, but collection and chemical analysis of separator-pressure oil samples is more costly and time-consuming. The second and third compositions shown in FIG. 4 both made use of gas collected at separator pressure, and oil collected at atmospheric pressure. In one case, the total composition was determined directly from the volumes of produced oil and gas, and their respective compositions. In the third case, the oil composition was corrected using K-values to account for gases that would be dissolved in the oil at separator pressure and temperature. The composition calculated in this third case agreed well with the most accurate available composition obtained from separator-pressure oil and gas samples. Consequently, correction of the composition of oil samples obtained at atmospheric pressure using K-value corrections is an acceptable alternative to analyzing oil samples obtained at separator pressure.

(b): Calculate Normalized Mole Fraction

Once the produced hydrocarbon composition is determined, the normalized mole fraction of each non-injectant component is calculated by dividing its mole fraction in the produced injectant-free hydrocarbon by the mole fraction of the same component in the original injectant-free hydrocarbon.

(c): Plot Normalized Mole Fraction

The normalized mole fraction is then plotted as a function of carbon number. For a given sample, compounds that cannot be extracted by the gas will all show similar values of the normalized mole fraction, resulting in a plateau value of the normalized mole fraction at high carbon numbers. This plateau value corresponds to the mole fraction of produced hydrocarbon that is recovered by direct displacement.

4. Choosing Wells for Remedial Action

The displaced fraction determined from normalized composition plots like those shown in FIG. 3 can be used to decide which production wells are targets for remedial action. Several uses of these data can be envisioned. Table 1, below, illustrates criteria that could be used to decide which wells are candidates for changes in production or injection strategies. Listed in the Table are ranking criteria, and their rationale. Wells would be ranked in some or all of these criteria, and chosen for remedial action based on their rank. Listed first is the injectant-oil-ratio that has been traditionally used for assessing well performance. As produced gas volumes increase, the cost to process it for disposal or reinjection increases. Conversely, increases in oil production rates result in more revenue. High injectant-oil-ratios at specific producers indicate that those producers are less profitable. Another commonly used criterion is the oil production rate. Low oil production rates are not profitable regardless of how much gas is injected or produced.

The next two ranking criteria are based on the method described above. The first of these is the displaced oil fraction. Wells in which displaced oil comprises most of the produced hydrocarbons may arise from the presence of thief zones. Consequently, much of the injectant may be flowing through an already depleted thief zone. Finally, a fourth ranking criterion is the injectant-extracted-hydrocarbon ratio. This gives a measure of the cost of processing produced injectant relative to the revenue generated by selling the hydrocarbons that are produced along with the injectant. This measurement gives a better indication of the profitability of continuing production of gas by only counting hydrocarbons that accompany the produced gas.

TABLE 1

Criteria For Ranking Wells As Candidates For Remedial Action

| Ranking Criterion | Rationale |
|---|---|
| High Injectant-Oil-Ratio | High cost of gas processing vs. revenue from sales of produced hydrocarbon. |
| Low Oil Production Rate | High cost of separating oil from other produced fluids vs. revenue from sales of produced hydrocarbons. |
| High Displaced Oil Fraction | Relatively small loss in oil production results from eliminating production of nitrogen. |
| High-Injectant-Extracted-Oil-Ratio | High cost of gas processing vs. revenue from sales of hydrocarbons carried by gas. |

5. Field Example: Ranking Based on Displaced Fraction

Figure 5:
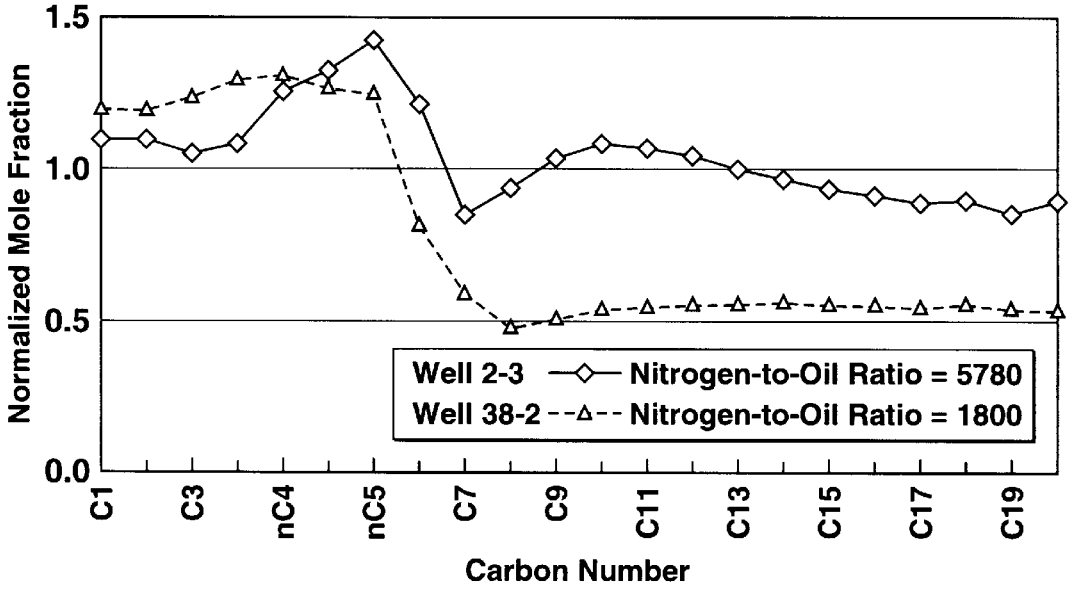
FIG. 5 illustrates the normalized mole fraction of hydrocarbon component as a function of carbon number based on actual hydrocarbon analyses of two oil samples obtained from two production wells in the Jay Field in northwest Florida.

FIG. 5 illustrates results of the analysis described steps one through three above, for two wells at Jay Field. As expected from FIG. 4, a plateau value is seen in the normalized mole fraction at carbon numbers greater than 10. In Well 2-3, the plateau value is around 0.90, indicating that 90 mole % of the produced hydrocarbon is recovered by direct displacement. This means that, although this well is producing large quantities of nitrogen, only 10 mole % of the produced hydrocarbon is recovered from the nitrogen-swept zone. Because only 10 mole % of the produced hydrocarbon is associated with the produced nitrogen, this well is a candidate for some change in injection strategy. Nitrogen could be diverted from this well with little loss in oil production.

For Well 38-2, the normalized mole fraction plateau value is around 0.55. Consequently, about 45 mole % of the produced hydrocarbon comes from the swept zone, so continued nitrogen injection is appropriate. Based on examination of these wells, it would be desirable to divert nitrogen from Well 2-3, and inject more nitrogen towards Well 38-2.

6. Comparison of Different Ranking Criteria

Table 2 lists the four parameters described above for six wells in the Jay field. These parameters were determined from the produced fluid rates and the composition of produced hydrocarbons, as described above. Different parameters give different indications of a need for remedial action. For example, based on injectant-extracted-oil-ratio, Well 2-3 would be the first well to receive attention because a disproportionate amount of injectant is being used to produce a relatively small amount of extracted hydrocarbons. However, based on injectant-oil-ratio, well 31-5 would be chosen for remedial action. Well 43-2, with a relatively low injectant-oil-ratio, might not be a candidate for remedial action. However, based on injectant-extracted-oil-ratio, this well would clearly be a candidate for remedial action. While the injectant-extracted-oil ratio is thought to be a measure of true well economic performance, since it relates the volume of produced gas to the quantity of hydrocarbons associated with that produced gas, all of the parameters listed in Table 1 may be useful.

Thus, selection of wells for remedial action would likely be based on those parameters described here as well as historical production data, flow surveys, and other available surveillance data. The method described here provides information about the effectiveness of gas injection that is not available from any other source.

TABLE 2

Various Ranking Criteria for 6 Production Wells in the Jay Field

| Well | Injectant-Oil-Ratio, moles/mole | Injectant-Extracted-Oil Ratio, moles/mole | Oil Rate, bbl/day | Displaced Hydrocarbon Fraction |
|---|---|---|---|---|
| 31-5 | 3.24 | 9.26 | 41 | 0.65 |
| 40-4B | 3.04 | 4.34 | 113 | 0.30 |
| 2-3 | 1.95 | 19.49 | 535 | 0.90 |
| 30-4B | 1.12 | 2.80 | 72 | 0.60 |
| 43-2 | 0.84 | 8.41 | 241 | 0.90 |
| 7-4 | 0.54 | 1.80 | 784 | 0.70 |
| 38-2 | 0.35 | 1.41 | 378 | 0.55 |

The preferred embodiments of practicing the invention have been described. It should be understood that the foregoing description is for illustrative purposes only and that other means and techniques can be employed without departing from the true scope of the invention defined in the following claims.

What I claim is:

1. A method for producing a fluid having hydrocarbons from a subterranean formation by introducing a substantially non-aqueous injectant into the formation, comprising:

a) obtaining a first fluid sample from the formation before introducing said non-aqueous injectant into the formation;

b) determining the composition of non-injectant hydrocarbons in said first fluid sample;

c) obtaining at least a second fluid sample from the formation after introducing said non-aqueous injectant into the formation;

d) determining the composition of non-injectant hydrocarbons in said second fluid sample;

e) determining the fraction of produced hydrocarbon fluid that is recovered by displacement using said compositional results in steps b) and d); and f) using said fraction result in step e) to guide adjustment of at least one of the rates at which said fluid having hydrocarbons is produced from the formation and said non-aqueous injectant is introduced into the formation, so that the amount of non-aqueous injectant used per unit of hydrocarbons produced from the formation is economically efficient.

2. The method of claim 1, wherein the non-aqueous injectant is injected in combination with water.

3. The method of claim 1 wherein the fraction of produced hydrocarbon fluid that is recovered by displacement is determined by:

a) calculating the normalized mole fraction of each hydrocarbon component using the compositional results of claim 1 steps b) and d);

b) plotting each said normalized fraction versus each said hydrocarbon component; and c) determining the normalized mole fraction found at lower volatility carbon numbers which is equivalent to the fraction of produced hydrocarbon fluid recovered by displacement.

4. The method in claim 3 wherein said calculation step is performed on an injectant-free basis, by dividing the injectant-free mole fraction of each non-injectant hydrocarbon component in said second fluid sample by the injectant-free mole fraction of the corresponding component in said first fluid sample.

5. The method of claim 1 wherein the non-aqueous injectant is selected from the group consisting of carbon dioxide, nitrogen, methane, and ethane.

6. The method of claim 1 wherein the non-aqueous injectant is selected from the group consisting of carbon dioxide and nitrogen.

* * * * *